US010658728B2

(12) United States Patent
Joseph et al.

(10) Patent No.: US 10,658,728 B2
(45) Date of Patent: May 19, 2020

(54) ANTENNA ASSEMBLY FOR VEHICLE

(71) Applicants: Hyundai Motor Company, Seoul (KR); Kia Motors Corporation, Seoul (KR)

(72) Inventors: Jack Joseph, Hyderabad (IN); Seung Hai Hwang, Hwaseong-si (KR); Jaejun Lee, Anyang-si (KR); Avinash K. Venkata, Hyderabad (IN)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 153 days.

(21) Appl. No.: 15/933,971

(22) Filed: Mar. 23, 2018

(65) Prior Publication Data

US 2019/0229394 A1 Jul. 25, 2019

(30) Foreign Application Priority Data

Jan. 22, 2018 (IN) ..... 201811002489

(51) Int. Cl.

| | |
|---|---|
| ***H01Q 1/32*** | (2006.01) |
| ***H01Q 1/12*** | (2006.01) |
| ***H01Q 3/08*** | (2006.01) |
| ***H01R 24/40*** | (2011.01) |
| ***H01Q 1/08*** | (2006.01) |
| ***H01R 24/54*** | (2011.01) |
| ***H01R 13/639*** | (2006.01) |

(52) U.S. Cl.

CPC ..... *H01Q 1/1214* (2013.01); *H01Q 1/08* (2013.01); *H01Q 1/3275* (2013.01); *H01Q 3/08* (2013.01); *H01R 13/639* (2013.01); *H01R 24/40* (2013.01); *H01R 24/545* (2013.01); *H01R 2201/02* (2013.01); *H01R 2201/26* (2013.01)

(58) Field of Classification Search

CPC ..... H01Q 1/32; H01Q 1/1214; H01Q 1/08; H01Q 1/3275; H01Q 3/08

USPC ..... 343/713, 712

See application file for complete search history.

(56) References Cited

U.S. PATENT DOCUMENTS

| | | | | |
|---|---|---|---|---|
| 7,358,910 | B2 * | 4/2008 | Blickle | H01Q 1/1214 343/713 |
| 7,633,452 | B2 * | 12/2009 | Noro | H01Q 21/28 343/700 MS |
| 8,044,871 | B2 * | 10/2011 | Takisawa | G01S 19/36 343/700 MS |

(Continued)

FOREIGN PATENT DOCUMENTS

KR 10-2011-0089585 A 8/2011

*Primary Examiner* — Huedung X Mancuso

(74) *Attorney, Agent, or Firm* — Morgan, Lewis & Bockius LLP

(57) ABSTRACT

An antenna assembly for a vehicle may include: a cover into which a lower end portion of an antenna is inserted; a base coupled to a lower side of the cover to form an internal compartment; a circuit board mounted on an upper surface of the base to be connected to the lower end portion of the antenna; a terminal mounted to the base wherein an upper end portion thereof is connected to the circuit board and a lower end portion thereof penetrates into the base; a wire connector disposed at the lower end portion of the terminal to be connected to a power wire; and a rotating pin coupling the wire connector with the terminal, wherein the wire connector may be rotatable about the rotating pin.

19 Claims, 13 Drawing Sheets

(56) References Cited

U.S. PATENT DOCUMENTS

| | | | | |
|---|---|---|---|---|
| 8,648,753 | B2 * | 2/2014 | Tamura | H01Q 1/1214<br>343/711 |
| 2013/0169489 | A1 * | 7/2013 | Tamura | H01Q 1/1214<br>343/702 |

* cited by examiner

ANTENNA ASSEMBLY FOR VEHICLE

CROSS-REFERENCE(S) TO RELATED APPLICATIONS

The present application claims priority to Indian Patent Application 201811002489, filed on Jan. 22, 2018, the entire contents of which is incorporated herein for all purposes by this reference.

BACKGROUND OF THE INVENTION

Field of the Invention

The present invention relates to an antenna assembly for a vehicle. More particularly, the present invention relates to an antenna assembly for a vehicle capable of improving freedom of design.

Description of Related Art

Generally, antennae for a vehicle may be currently classified into a manual type of antenna, a glass type of antenna, a micro type of antenna, and the like.

Among the antennae, the manual type of antenna is disadvantageous in terms of external appearance because it is exposed to the outside of the vehicle, and the glass type of antenna has a drawback in that receiving performance thereof is low. Accordingly, recently, the micro type of antenna has tended to be applied to the vehicle.

The micro type of antenna has a small external shape, wherein an external appearance thereof is not affected even though it is exposed to the outside. The micro type of antenna is also provided with a circuit board for amplifying signals, wherein it has excellent receiving performance in comparison with the glass type of antenna.

However, when the micro type antenna is mounted on a roof of a vehicle, connecting directions of a feeder cable and a power wire may be different from each other in case of mounting on a left side of the roof and in case of mounting on a right side of the roof. That is, productivity may be deteriorated as the micro type antenna which is mounted on the left side of the roof and the micro type antenna which is mounted on the right side of the roof are respectively manufactured to have a different extending direction of a connector coupling a terminal with a power wire.

The information disclosed in this Background of the Invention section is only for enhancement of understanding of the general background of the invention and should not be taken as any form of suggestion that this information forms the prior art already known to a person skilled in the art.

BRIEF SUMMARY

Various aspects of the present invention are directed to providing an antenna assembly for a vehicle having the advantages of applying to all cases of mounting on the left or right side of a roof.

An antenna assembly for a vehicle according to an exemplary embodiment of the present invention may include: a cover into which a lower end portion of an antenna is inserted; a base coupled to a lower side of the cover forming an internal compartment; a circuit board mounted on an upper surface of the base to be connected to the lower end portion of the antenna; a terminal mounted to the base wherein an upper end portion thereof is connected to the circuit board and a lower end portion thereof penetrates into the base; a wire connector disposed at the lower end portion of the terminal to be connected to a power wire; and a rotating pin coupling the wire connector with the terminal.

The wire connector may be rotatable about the rotating pin.

A terminal mounting hole may be formed at the base wherein the lower end portion of the terminal penetrates into the base.

A cable connecting hole, which is connected to a feeder cable, may be formed at the base wherein the feeder cable is connected to the circuit board.

The wire connector may be rotatable wherein a direction of extending the wire connector coupled with the power wire is variable up to 180 degrees.

A board connecting portion, which is formed or disposed at the upper end portion of the terminal, may be inserted into and connected to the circuit board.

The base and the cover may be coupled by a fastening member after the terminal with the circuit board are coupled to the base in a state of coupling the terminal with the circuit board, and then the wire connector may be coupled to the terminal by the rotating pin.

As the rotating pin penetrates into the wire connector through a pin penetration hole formed at the wire connector and the rotating pin is then disposed in a pin insertion groove formed at the lower end portion of the terminal, the rotating pin may couple the wire connector and the terminal wherein the wire connector and the terminal are in contact with each other.

The rotating pin may be inserted into the pin insertion groove to be rotatable.

The wire connector may include: an extended portion, extended to be vertical with respect to a direction of inserting the rotating pin from a part thereof into which the rotating pin is inserted to be connected to the power wire; and a blocking protrusion, protruded from a upper surface thereof which is in contact with the terminal.

The terminal may include: a blocking groove depressed from a lower surface thereof which is in contact with the wire connector so that the blocking protrusion is disposed therein; and a blocking step protruded from a lower surface thereof to cover both sides with a width direction of the wire connector.

The blocking groove and the blocking protrusion may be respectively formed to be symmetrical with respect to the rotating pin.

The rotating pin may include an external part which is formed in a hollow cylindrical shape having a closed upper surface, an open lower surface, and an internal part which is inserted into the hollow of the external part.

A head, configured to have an external circumference to be gradually increased and then be decreased in an upward direction from the upper surface of the external part and is positioned in a head receiving region formed at an upper portion of the pin insertion groove, may be formed at the closed upper surface of the external part.

The external circumference of the head may be formed in a curved surface shape.

The head may be radially divided to four equal parts.

The head divided into four equal parts may form a gap having a cross-shape.

The external circumference of the head may have a portion configured so that an external diameter thereof is longer than an internal diameter of the pin insertion groove.

Coupling protrusions, which are radially protruded in a plurality from the external circumference of the external part, may be formed near the open lower surface of the external part, and a plurality of coupling grooves may be formed along an internal circumference of the pin penetration hole to respectively have a position and a corresponding with the coupling protrusion.

A stopper, which is disposed to be lower than the coupling protrusion and protrudes along the external circumference of the external part, may be formed at the external part to be blocked at a lower surface of the wire connector when the rotating pin is inserted into the pin insertion groove.

The antenna assembly for a vehicle may further include: a side hole bored from the external circumference of the external part to the hollow; a side protrusion gradually protruded in a downward direction from an external circumference of the internal part to be inserted into the side hole; and an escape prevention groove disposed wherein the side protrusion is positioned therein and formed along an internal circumference of the pin insertion groove wherein interference with the side protrusion by the rotation of the rotating pin is prevented.

The side protrusion may have a given play, or backlash, inside the escape prevention groove wherein the movement of the rotating pin in a longitudinal direction is to be possible.

The rotating pin and the wire connector may rotate in a state of moving the rotating pin and the wire connector for separating the upper surface of the wire connector and the lower surface of the terminal by a predetermined distance.

According to an exemplary embodiment of the present invention, productivity can be improved as uniform manufacturing is possible irrespective of mounting positions by rotating the wire connector to be applicable to all cases of mounting on the left or right side of a roof.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
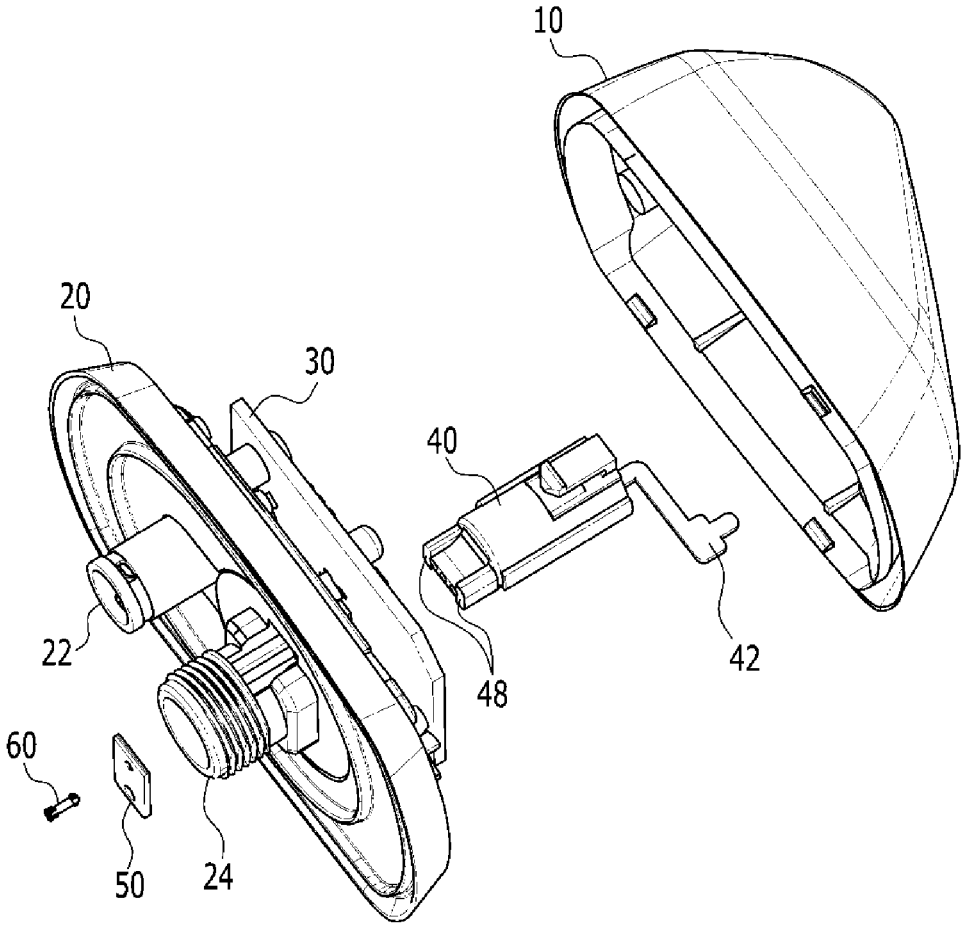
FIG. 1 is a schematic diagram of an antenna assembly for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in prat by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

FIG. 1 is a schematic diagram of an antenna assembly for a vehicle according to an exemplary embodiment of the present invention.

As shown in FIG. 1, an antenna assembly for a vehicle according to an exemplary embodiment of the present invention includes a cover 10, a base 20, a circuit board 30, a terminal 40, a wire connector 50, and a rotating pin 60.

The cover 10 is an upper housing of the antenna assembly.

The base 20 is a lower housing, which is coupled to a lower side of the cover 10, of the antenna assembly.

The circuit board 30 is mounted on an upper surface of the base 20 to be disposed in an internal compartment which is formed by coupling the cover 10 with the base 20. Herein, the circuit board 30 may be a printed circuit board (PCB) which is well-known to a person of an ordinary skill in the art.

The terminal 40 is mounted to the base 20 and is configured such that an upper end portion thereof is connected to the circuit board 30.

The wire connector 50 is disposed at a lower end portion of the terminal 40.

The rotating pin 60 is configured to couple the wire connector 50 with the terminal 40.

Figure 2:
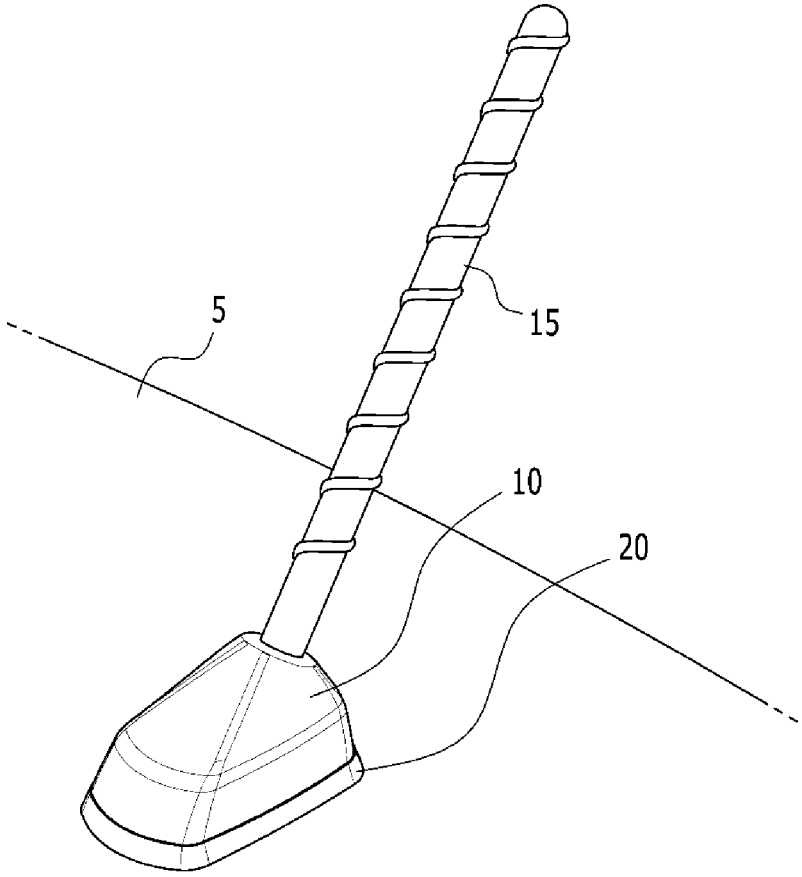
FIG. 2 is a drawing showing an upper surface of a roof panel to which an antenna assembly for a vehicle is mounted according to an exemplary embodiment of the present invention.
Figure 3:
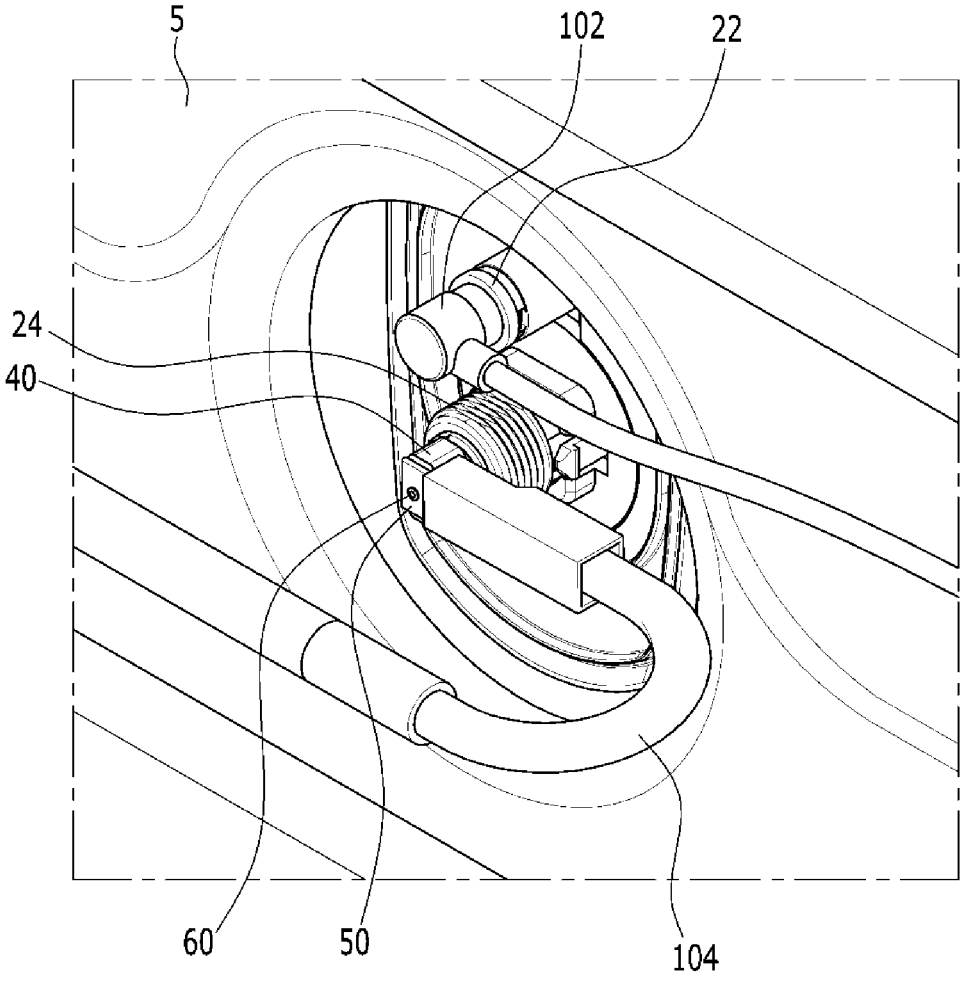
FIG. 3 and FIG. 4 are drawings showing a lower surface of a roof panel to which an antenna assembly for a vehicle is mounted according to an exemplary embodiment of the present invention.
Figure 4:
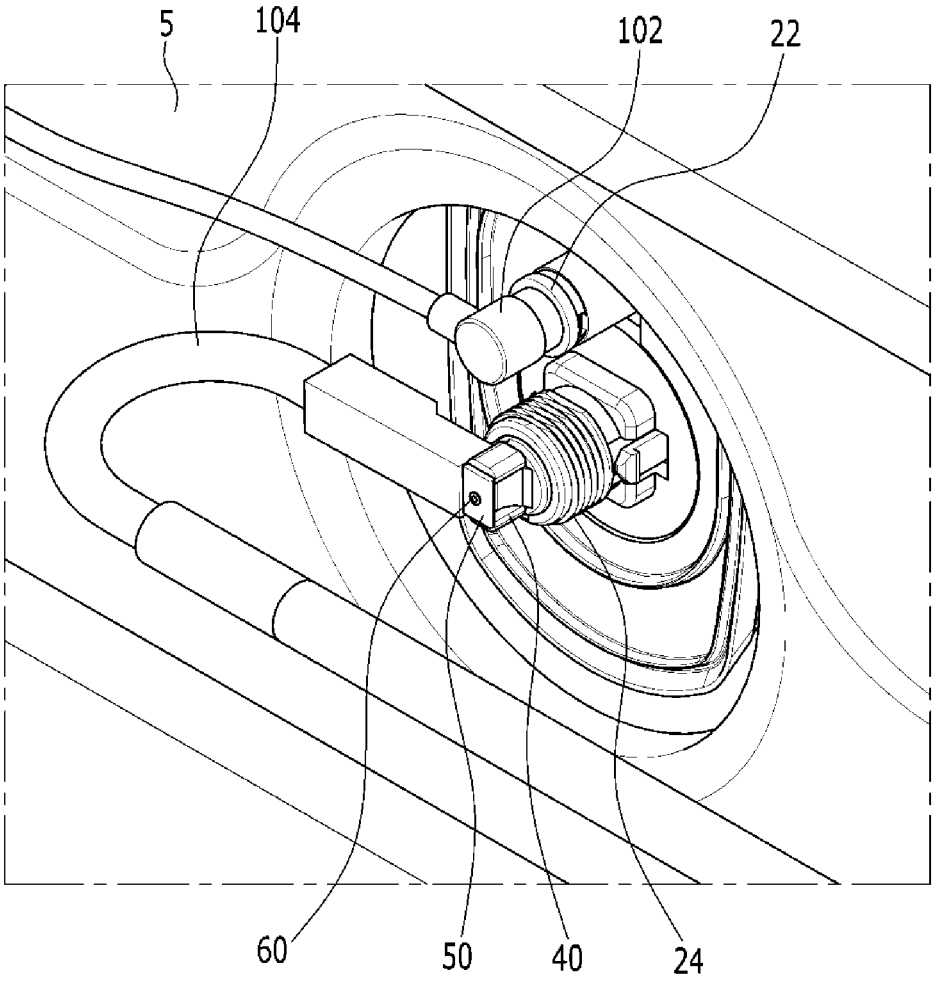

FIG. 2 is a drawing showing an upper surface of a roof panel to which an antenna assembly for a vehicle is mounted according to an exemplary embodiment of the present invention, and FIG. 3 and FIG. 4 are drawings showing a lower surface of a roof panel to which an antenna assembly for a vehicle is mounted according to an exemplary embodiment of the present invention.

As shown in FIG. 2, the housing of the antenna assembly formed by coupling the cover 10 with the base 20 is mounted on an upper surface of a roof panel 5 for a vehicle. In addition, an upper end portion of an antenna 15 is extended upwardly from the roof panel 5 and a lower end portion of an antenna 15 penetrates into the cover 10 to be connected to the circuit board 30. In the present regard, the circuit board 30 is configured to amplify signals transmitted and/or received through the antenna 15.

As shown in FIG. 3 and FIG. 4, a terminal mounting hole 24, through which the terminal 40 is mounted, is formed at the base 20. In addition, the lower end portion of the terminal 40 mounted to the base 20 penetrates into the roof panel 5 to be protruded from a lower surface of the roof panel 5.

Meanwhile, the antenna assembly may be disposed to right side or left side of the roof panel 5. In FIG. 3, it is illustrated that a feeder cable 102 and a power wire 104 are connected to the antenna assembly disposed to left side of the roof panel 5, and in FIG. 4, it is illustrated that a feeder cable 102 and a power wire 104 are connected to the antenna assembly disposed to right side of the roof panel 5. Herein, the feeder cable 102 and the power wire 104 are well-known to a person of an ordinary skill in the art, so the detailed description thereof will be omitted.

The feeder cable 102 is connected to a cable connecting hole 22 which is formed at the base 20, being, being connected to the circuit board 30, and the power wire 104 is connected to the wire connector 50 which is disposed the lower end portion of the terminal 40. In the present regard, when the power wire 104 is connected to the right side of the wire connector 50 in a case that the antenna assembly is disposed to left side of the roof panel 5 (Referring to FIG. 3), the power wire 104 may be connected to the left side of the wire connector 50 in a case that the antenna assembly is disposed to right side of the roof panel 5 (Referring to FIG. 4). That is, a direction of connecting the power wire 104 to the wire connector 50 may be varied by 180 degrees.

In other words, in an antenna assembly for a vehicle according to an exemplary embodiment of the present invention, it is possible that a direction of extending the wire connector 50 connected to the power wire 104 is varied by 180 degrees.

FIG. 5 is an assembly view of an antenna assembly for a vehicle according to an exemplary embodiment of the present invention.

Figure 5A:
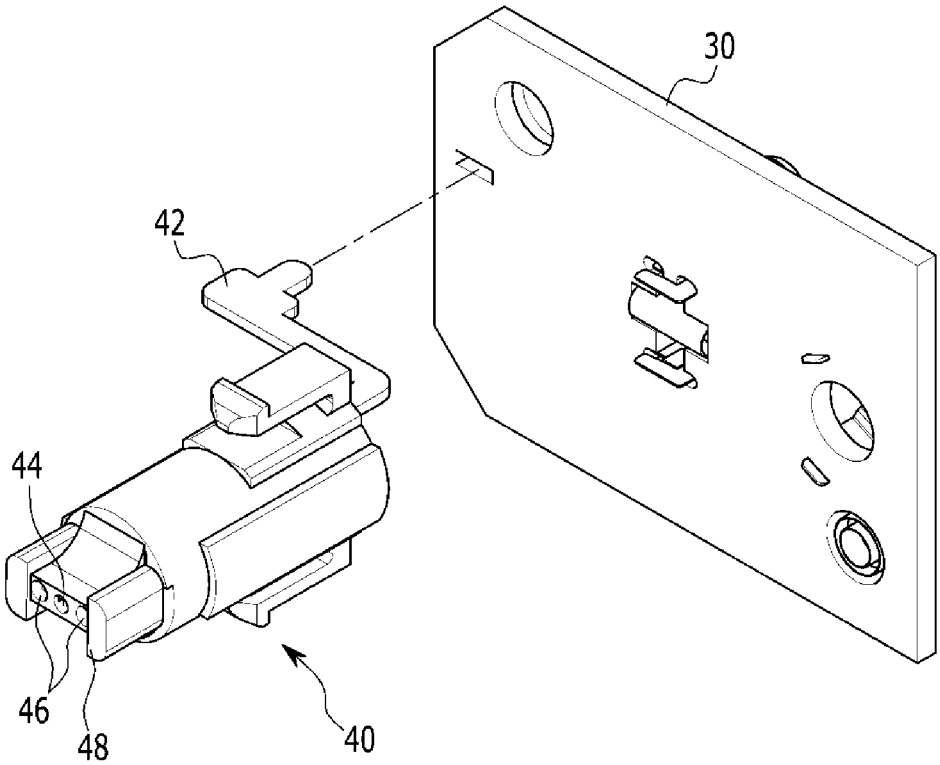
FIG. 5A, FIG. 5B, FIG. 5C, and FIG. 5D are an assembly view of an antenna assembly for a vehicle according to an exemplary embodiment of the present invention.

As shown in FIG. 5A, a board connecting portion 42 is formed or disposed at the upper end portion of the terminal 40, and the terminal 40 is coupled with the circuit board 30 as a portion of the board connecting portion 42 is inserted into the circuit board 30.

Figure 5B:
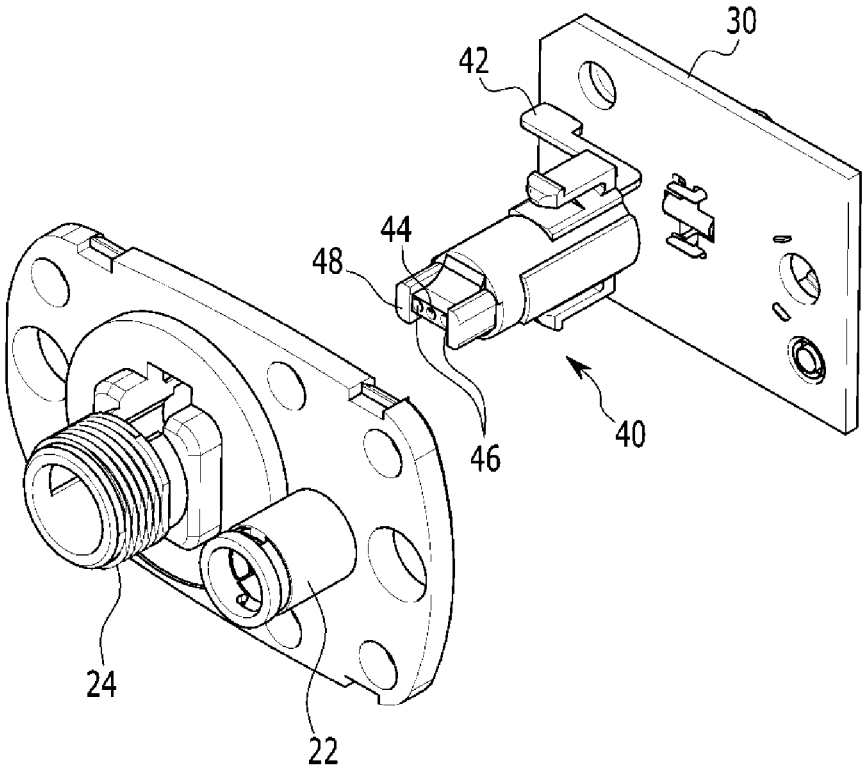

As shown in FIG. 5B, the terminal 40 and the circuit board 30 are coupled to the base 20 in a state of coupling the terminal 40 with the circuit board 30. At the present time, the lower end portion of the terminal 40 is coupled to penetrate into the base 20 through the terminal mounting hole 24.

Figure 5C:
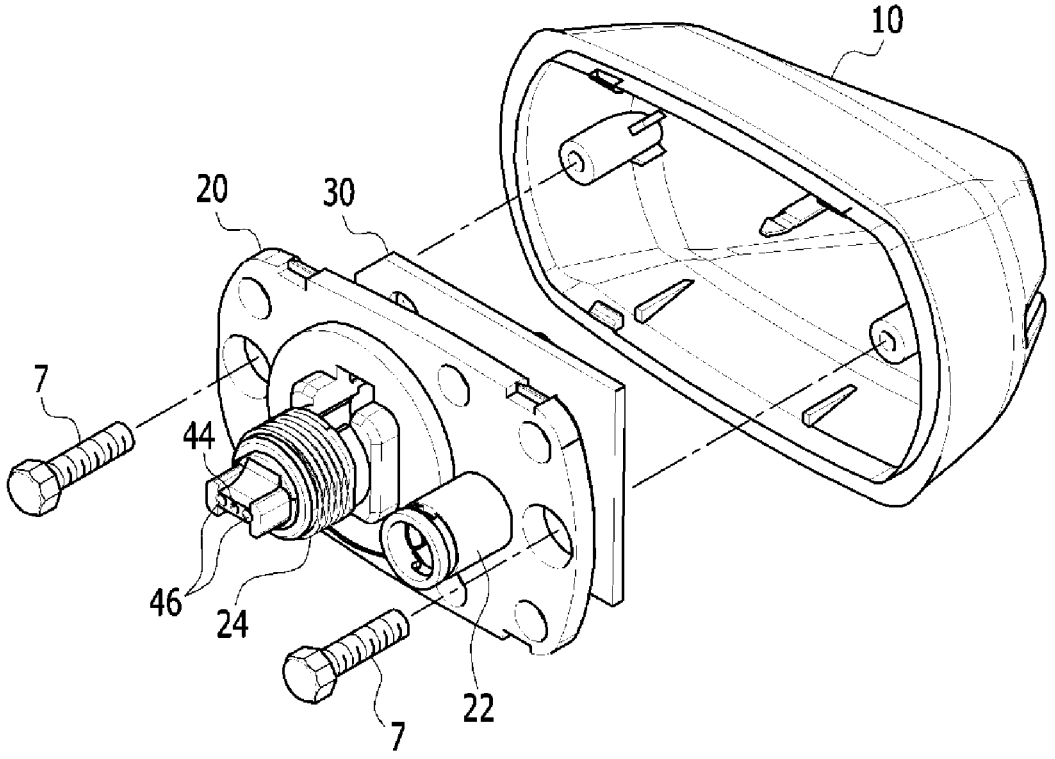

As shown in FIG. 5C, the base 20 and the cover 10 are coupled by a fastening member including a screw 7 in a state of coupling the terminal 40 and the circuit board 30 to the base 20. As such, assembly of the antenna assembly is completed when the wire connector 50 is coupled to the terminal 40 by the rotating pin 60 (Referring to FIG. 5D).

Figure 5D:
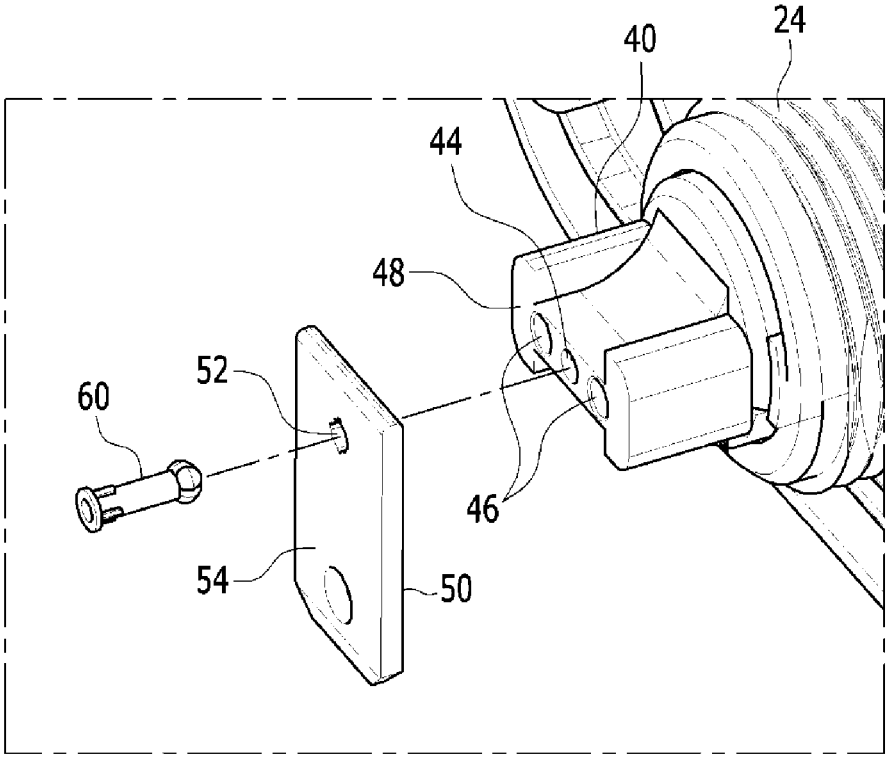

As shown in FIG. 5D, a pin penetration hole 52 is formed at the wire connector 50, and a pin insertion groove 44 is formed at the lower end portion of the terminal 40. In addition, the rotating pin 60 couples the wire connector 50 and the terminal 40 wherein the wire connector 50 and the terminal 40 are contacted to each other by penetrating into the wire connector 50 through the pin penetration hole 52 and being disposed in the pin insertion groove 44.

Figure 6:
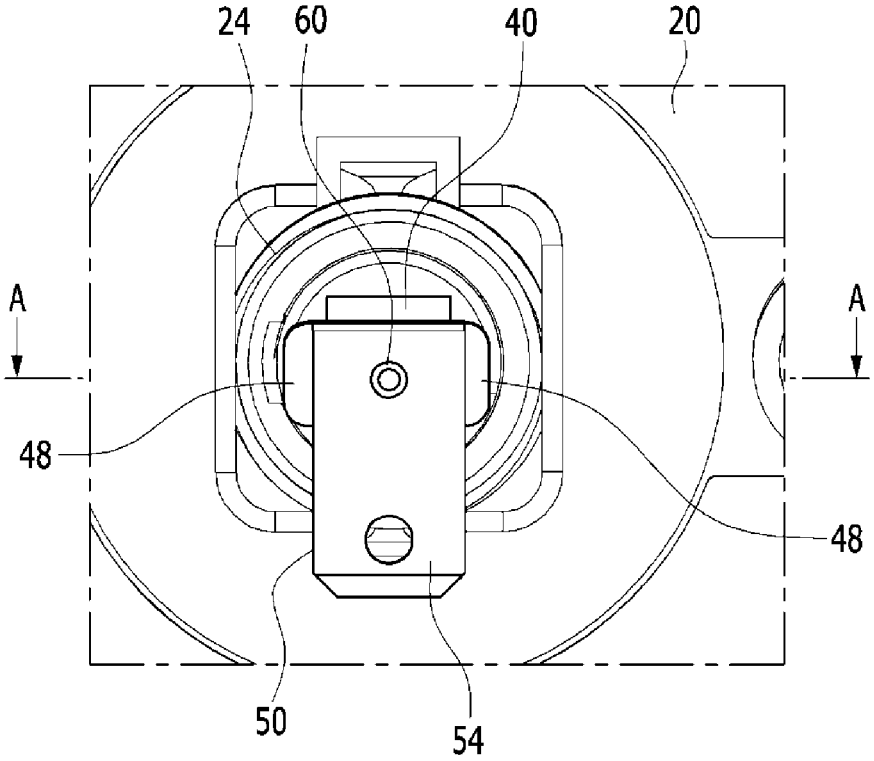
FIG. 6 is an underside view of an antenna assembly for a vehicle according to an exemplary embodiment of the present invention.
Figure 7:
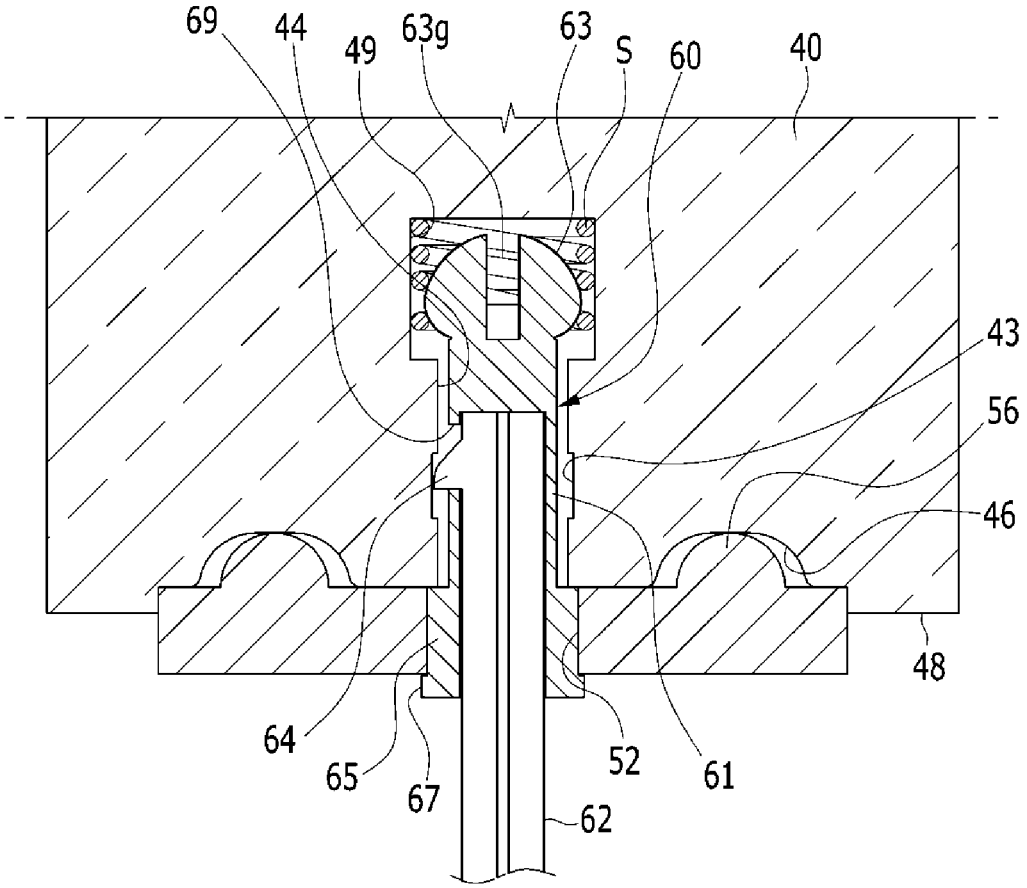
FIG. 7 is a cross-sectional view taken along a line A-A in FIG. 6.

FIG. 6 is an underside view of an antenna assembly for a vehicle according to an exemplary embodiment of the present invention, and FIG. 7 is a cross-sectional view taken along a line A-A in FIG. 6.

As shown in FIG. 6 and FIG. 7, the rotating pin 60 is inserted into the pin insertion groove 44 to be rotatable, and the wire connector 50 includes an extended portion 54 and a blocking protrusion 56, and the terminal 40 includes a blocking groove 46 and a blocking step 48.

The extended portion 54 is a part to be connected to the power wire 104. In addition, the extended portion 54 is extended from a part to form the pin penetration hole 52 and contact to the terminal 40 to be vertical with respect to a direction of inserting the rotating pin 60.

The blocking protrusion 56 is formed to be protruded from an upper surface of the wire connector 50 which is faced to the terminal 40 and is in contact with the terminal 40.

The blocking groove 46 is formed to be depressed from a lower surface of the terminal 40 which is faced to the wire connector 50 and is in contact with the wire connector 50. In addition, the blocking groove 46 is disposed so that the blocking protrusion 56 is disposed therein. Further, relative rotation between the wire connector 50 and the terminal 40 is prevented as the blocking protrusion 56 is disposed in the blocking groove 46.

Meanwhile, the blocking groove 46 and the blocking protrusion 56 may be respectively formed to be symmetrical with respect to the rotating pin 60 wherein the blocking protrusion 56 can be disposed in the blocking groove 46 even after the wire connector 50 rotates 180 degrees around the rotating pin 60. In FIG. 7, a pair of blocking grooves 46 and a pair of blocking protrusions 56 are illustrated, but the present invention is not limited thereto.

When a direction of extending the extended portion 54 is defined to a longitudinal direction of the wire connector 50, the blocking step 48 is formed to be protruded from the lower surface of the terminal 40 to cover both sides with a width direction of the wire connector 50. In addition, the blocking step 48 is configured to prevent relative rotation between the wire connector 50 and the terminal 40.

Figure 8:
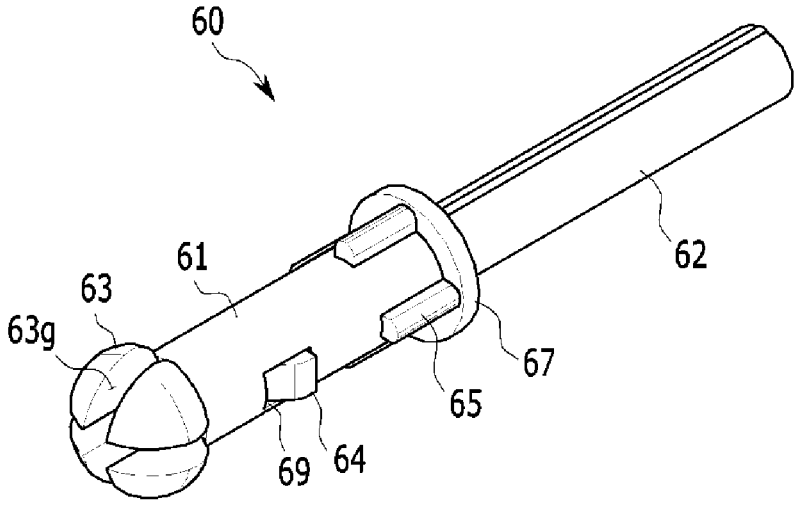
FIG. 8 is a perspective view of a rotating pin according to an exemplary embodiment of the present invention.

FIG. 8 is a perspective view of a rotating pin according to an exemplary embodiment of the present invention.

As shown in FIG. 8, the rotating pin 60 includes an external part 61 and an internal part 62, and a head 63, a coupling protrusion 65, a stopper 67, and a side hole 69 are formed at the external part 61, and a side protrusion 64 is formed at the internal part 62.

The external part 61 is formed in a hollow cylindrical shape having a closed upper surface and an open lower surface. In addition, the internal part 62 is inserted into the hollow of the external part 61.

The head 63 is formed at the closed upper surface of the external part 61. In addition, an external circumference of the head 63 is formed in a curved surface shape which is gradually increased and then decreased in an upward direction from the upper surface of the external part 61. That is, the external circumference of the head 63 includes a portion configured so that an external diameter thereof is longer than the external diameter of the external part 61. Further, the head 63 may be radially divided to four equal parts, and the head 63 divided to four equal parts forms a gap 63*g* having a cross-shape. Meanwhile, the external diameter of the external circumference of the head 63, to be longer than the external diameter of the external part 61, is longer than an internal diameter of the pin insertion groove 44. Therefore, the rotating pin 60 is inserted into the pin insertion groove 44 as the head 63 is elastically transformed by contraction of the gap 63*g*, and the rotating pin 60 is prevented from escaping the pin insertion groove 44 after the head 63 is inserted to be positioned in a head receiving region 49 which is formed at an upper portion of the pin insertion groove 44 (Referring to FIG. 7). At the present time, the head 63 is elastically supported and upwardly pulled by a spring S which is provided in the head receiving region 49.

The coupling protrusion 65 is formed near the open lower surface of the external part 61. In addition, the coupling protrusions 65 are radially protruded in a plurality from the external circumference of the external part 61.

The stopper 67 is formed near the open lower surface of the external part 61 and is disposed to be lower than the coupling protrusion 65. In addition, the stopper 67 protrudes along the external circumference of the external part 61. Further, as the stopper 67 is blocked at a lower surface of the wire connector 50 when the rotating pin 60 is inserted into the pin insertion groove 44, the stopper 67 is configured to prevent that the rotating pin 60 is excessively inserted.

The side hole 69 is bored from the external circumference of the external part 61 to the hollow.

The side protrusion 64 protrudes from an external circumference of the internal part 62 and is inserted into the side hole 69. In addition, the side protrusion 64 is gradually protruded in a downward direction thereof.

Figure 9:
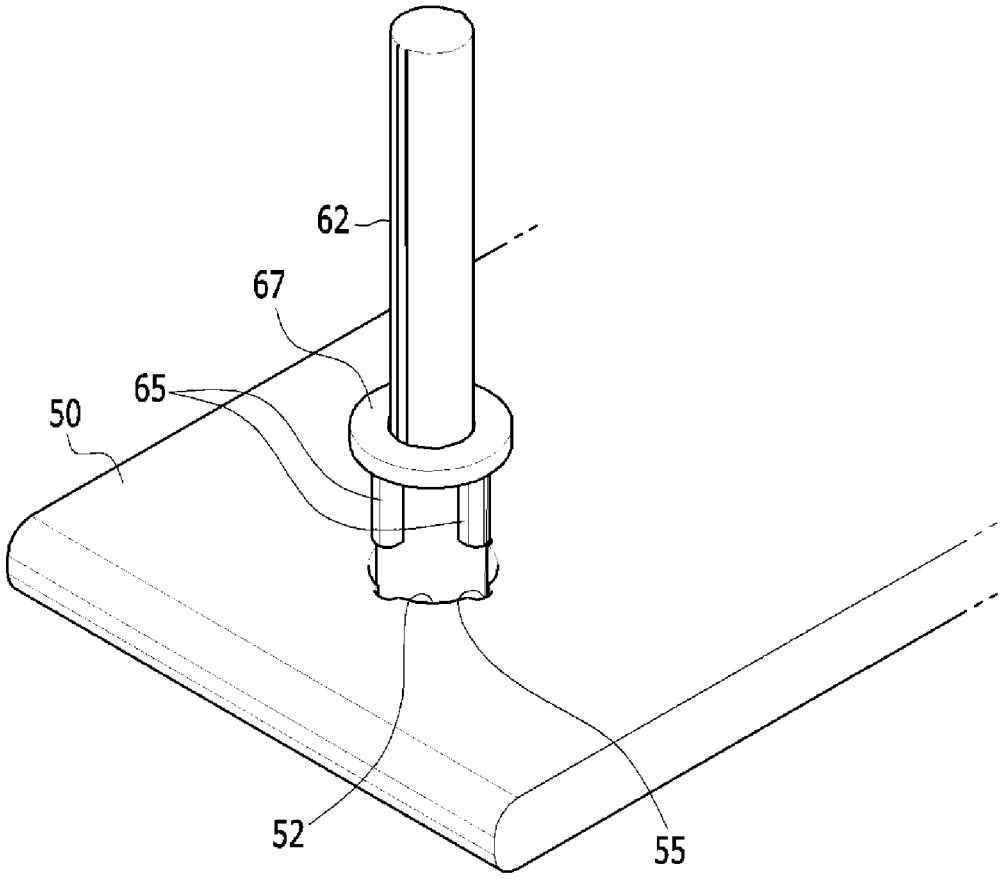
FIG. 9 is a drawing illustrating that a rotating pin is inserted into a wire connector according to an exemplary embodiment of the present invention.

FIG. 9 is a drawing illustrating that a rotating pin is inserted into a wire connector according to an exemplary embodiment of the present invention.

As shown in FIG. 9, a coupling groove 55 is formed at the pin penetration hole 52 of the wire connector 50.

The coupling grooves 55 are radially formed in a plurality along an internal circumference of the pin penetration hole 52. In addition, the coupling groove 55 has a position and a shape to be corresponded with the coupling protrusion 65. That is, when the rotating pin 60 is inserted into the pin penetration hole 52, the coupling protrusion 65 is disposed in the coupling groove 55. Thus, relative rotation between the rotating pin 60 and the wire connector 50 is prevented.

Figure 10:
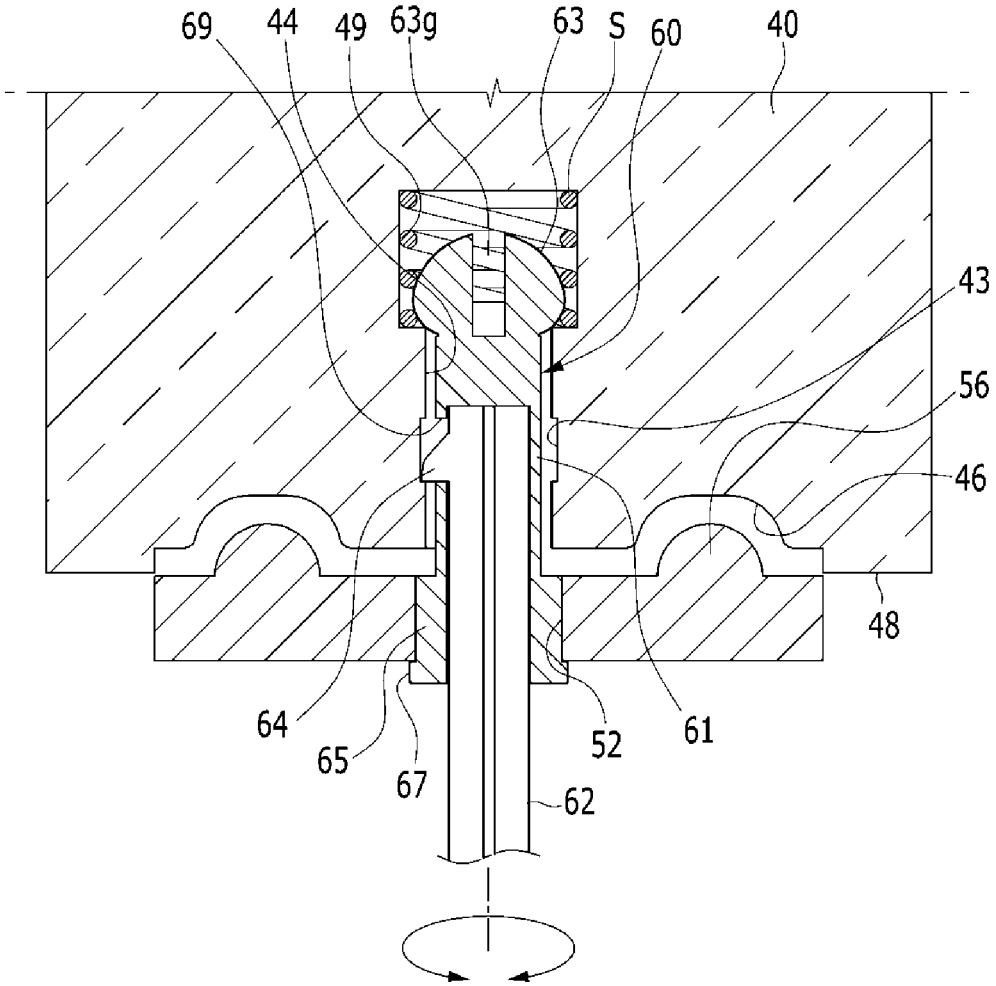
FIG. 10 is a drawing illustrating a rotation of a wire connector according to an exemplary embodiment of the present invention.

FIG. 10 is a drawing illustrating rotation of a wire connector according to an exemplary embodiment of the present invention.

As shown in FIG. 10, the rotating pin 60 and the wire connector 50 can be rotated in a state of moving the rotating pin 60 and the wire connector 50 wherein the upper surface of the wire connector 50 and the lower surface of the terminal 40 are apart at a predetermined distance from each other. In addition, as the blocking protrusion 56 is disposed in and fixed to the blocking groove 46 after the wire connector 50 and the rotating pin 60 are rotated by 180 degrees, it is possible that the power wire 104 is connected in a direction which is different by 180 degrees from a direction of connecting the power wire 104 before the wire connector 50 is rotated.

In the present regard, an escape prevention groove 43 is formed at an internal circumference of the pin insertion groove 44. The escape prevention groove 43 is disposed wherein the side protrusion 64 is positioned therein and is formed along the internal circumference of the pin insertion groove 44 wherein interference with the side protrusion 64 by the rotation of the rotating pin 60 is prevented. In addition, the side protrusion 64 has a given play, or backlash, inside the escape prevention groove 43 wherein the movement of the rotating pin 60 in a longitudinal direction for separating the upper surface of the wire connector 50 and the lower surface of the terminal 40 at a predetermined distance is possible. Furthermore, as the side protrusion 64 is blocked by the escape prevention groove 43 when the rotating pin 60 is moved in the longitudinal direction to separate the upper surface of the wire connector 50 and the lower surface of the terminal 40 at a predetermined distance, it is prevented that the rotating pin 60 escapes from the pin insertion groove 44.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An antenna assembly for a vehicle, the antenna assembly comprising:

a cover into which a lower end portion of an antenna is inserted;

a base coupled to a lower side of the cover to form an internal compartment;

a circuit board mounted on an upper surface of the base to be connected to the lower end portion of the antenna;

a terminal mounted to the base wherein an upper end portion thereof is connected to the circuit board and a lower end portion thereof penetrates into the base;

a wire connector disposed at the lower end portion of the terminal to be connected to a power wire; and a rotating pin coupling the wire connector with the terminal, wherein the wire connector is rotatable about the rotating pin, and wherein as the rotating pin penetrates into the wire connector through a pin penetration hole which is formed at the wire connector and then the rotating pin is disposed in a pin insertion groove which is formed at the lower end portion of the terminal, the rotating pin couples the wire connector and the terminal, and the wire connector and the terminal are in contact with each other.

2. The antenna assembly of claim 1, wherein a terminal mounting hole is formed at the base and wherein the lower end portion of the terminal penetrates into the base.

3. The antenna assembly of claim 1, wherein a cable connecting hole, which is connected to a feeder cable, is formed at the base and wherein the feeder cable is connected to the circuit board.

4. The antenna assembly of claim 1, wherein the wire connector is rotatable wherein a direction of extending the wire connector connected to the power wire is varied by 180 degrees.

5. The antenna assembly of claim 1, wherein a board connecting portion, which is formed or disposed at the upper end portion of the terminal, is inserted into and connected to the circuit board.

6. The antenna assembly of claim 1, wherein the base and the cover are coupled by a fastening member after the terminal with the circuit board are coupled to the base in a state of coupling the terminal with the circuit board, and then the wire connector is coupled to the terminal by the rotating pin.

7. The antenna assembly of claim 1, wherein the rotating pin is inserted into the pin insertion groove to be rotatable.

8. The antenna assembly of claim 1, wherein the wire connector includes:

an extended portion extended to be vertical with respect to a direction of inserting the rotating pin from a part thereof into which the rotating pin is inserted to be connected to the power wire; and a blocking protrusion protruded from an upper surface thereof which is contacted to the terminal, wherein the terminal includes:

a blocking groove recessed from a lower surface thereof which is in contact with the wire connector wherein the blocking protrusion is disposed therein; and a blocking step protruded from a lower surface thereof to cover a first side and a second side with a width direction of the wire connector.

9. The antenna assembly of claim 8, wherein the blocking groove and the blocking protrusion are respectively formed to be symmetrical to the rotating pin.

10. The antenna assembly of claim 1, wherein the rotating pin includes an external part which is formed in a hollow cylindrical shape having a closed upper surface and an open lower surface and an internal part which is inserted into the hollow of the external part.

11. The antenna assembly of claim 10, wherein a head, which has an external circumference to be increased and then be decreased in an upward direction from the upper surface of the external part and is disposed in a head receiving region formed at an upper portion of the pin insertion groove, is formed at the closed upper surface of the external part.

12. The antenna assembly of claim 11, wherein the external circumference of the head is formed in a curved surface shape.

13. The antenna assembly of claim 11, wherein the head is radially divided to four equal parts.

14. The antenna assembly of claim 13, wherein the head divided to four equal parts forms a gap having a cross-shape.

15. The antenna assembly of claim 11, wherein the external circumference of the head has a portion configured so that an external diameter thereof is longer than an internal diameter of the pin insertion groove.

16. The antenna assembly of claim 10, wherein coupling protrusions, which are radially protruded in a plurality from the external circumference of the external part, are formed adjacent to the open lower surface of the external part, and a plurality of coupling grooves are formed along an internal circumference of the pin penetration hole to respectively have a position and a shape to be corresponded with the coupling protrusion.

17. The antenna assembly of claim 16, wherein a stopper, which is disposed to be lower than the coupling protrusion and protrudes along the external circumference of the external part, is formed at the external part to be blocked by a lower surface of the wire connector when the rotating pin is inserted into the pin insertion groove.

18. The antenna assembly of claim 10, further including:

a side hole bored from the external circumference of the external part to the hollow;

a side protrusion protruded in a downward direction from an external circumference of the internal part to be inserted into the side hole; and an escape prevention groove disposed such that the side protrusion is disposed therein and formed along an internal circumference of the pin insertion groove such that interference with the side protrusion by the rotation of the rotating pin is prevented, wherein the side protrusion has a given play, or backlash, inside the escape prevention groove such that that a movement of the rotating pin in a longitudinal direction thereof is to be possible.

19. The antenna assembly of claim 1, wherein the rotating pin and the wire connector rotate in a state of moving the rotating pin and the wire connector for separating the upper surface of the wire connector and the lower surface of the terminal at a predetermined distance.

* * * * *